United States Patent [19]

Thuries et al.

[11] Patent Number: 4,880,946

[45] Date of Patent: Nov. 14, 1989

[54] HIGH-OR MEDIUM-TENSION COMPRESSED-GAS CIRCUIT BREAKER TAKING CIRCUIT-BREAKING ENERGY FROM THE ARC

[75] Inventors: Edmond Thuries, Pusignan; Denis Dufournet, Bron; Michel Perret, Bourgoin-Jallieu, all of France

[73] Assignee: Societe Anonyme dite: Alsthom, Paris, France

[21] Appl. No.: 222,641

[22] Filed: Jul. 21, 1988

[30] Foreign Application Priority Data

Aug. 3, 1987 [FR] France ..... 87 10988

[51] Int. Cl.[4] ..... H01H 33/88

[52] U.S. Cl. ..... 200/148 A; 200/148 R

[58] Field of Search ..... 200/148 A, 148 R

[56] References Cited

U.S. PATENT DOCUMENTS 3,985,988 12/1976 Korner et al. ..... 200/150 E 4,711,978 12/1987 Jeanjean et al. ..... 200/148 A

*Primary Examiner*—Robert S. Macon

*Attorney, Agent, or Firm*—Sughrue, Mion, Zinn, Macpeak & Seas

[57] ABSTRACT

A high- or medium-tension compressed gas circuit breaker taking circuit-breaking energy from the arc, the circuit breaker being of the type comprising:

a fixed assembly including main contacts (8*a*) and arc contacts (21*a*);

a moving assembly including main contacts (26) and arc contacts (25);

a blast volume (VI) including a piston (12) which moves on contact separation and urges compressed gas through a blast nozzle (7) which opens over the zone where a main arc forms when the arc contacts separate, and a set of auxiliary contacts (22*a*, 21*c*) in series with the arc contacts for creating an auxiliary arc in the volume (V2) situated behind the piston, the circuit breaker further including means (23, 24) for allowing the auxiliary contacts to separate only when the pressure in the blast zone reaches a predetermined threshold.

6 Claims, 4 Drawing Sheets

HIGH-OR MEDIUM-TENSION COMPRESSED-GAS CIRCUIT BREAKER TAKING CIRCUIT-BREAKING ENERGY FROM THE ARC

The present invention relates to a high- or medium-tension compressed dielectric gas circuit breaker in which the circuitbreaking energy for breaking high currents is taken, in part, from the arc.

BACKGROUND OF THE INVENTION

Circuit breakers are known which include a piston for blasting the arc, with the piston-operating energy being obtained, at least in part, from the gas whose pressure increases due to the increase in temperature produced by the arc. One such conduit breaker is described in French Pat. No. 77 19086.

Proposals have been made to further increase the pressure to which the piston is subjected by equipping the circuit breaker with a set of electrodes for forming a second arc which is established at the same time as the first.

One such circuit breaker is described, for example, in U.S. Pat. No. 3,985,988.

However, it has been observed that such a circuit breaker suffers from drawbacks.

By multiplying the number of arc zones, there is an increased risk of an arc restriking after a circuit-breaking operation. In particular the second arc is not of any use for interrupting low currents, in particular low inductive currents.

An object of the invention is to provide a circuit breaker including an arc-blasting piston and in which a second arc for increasing the force exerted on the piston is established solely when the current to be interrupted is high (short circuit element, for example), with said auxiliary arc not being established when the current to be interrupted is low (inductive current, no-load circuit breaking).

SUMMARY OF THE INVENTION

The present invention provides a high- or medium-tension compressed gas circuit breaker taking circuit-breaking energy from the arc, the circuit breaker being of the type comprising:

a fixed assembly including main contacts and arc contacts;

a moving assembly including main contacts and arc contacts;

a blast volume including a piston which moves on contact separation and urges compressed gas through a blast nozzle which opens over the zone where a main arc forms when the arc contacts separate, and a set of auxiliary contacts in series with the arc contacts for creating an auxiliary arc in the volume situated behind the piston, the circuit breaker further including means for allowing the auxiliary contacts to separate only when the pressure in the blast zone reaches a predetermined threshold.

BRIEF DESCRIPTION OF THE DRAWINGS

Embodiments of the invention are described by way of example with reference to the accompanying drawings, in which.

MORE DETAILED DESCRIPTION

Figure 1:
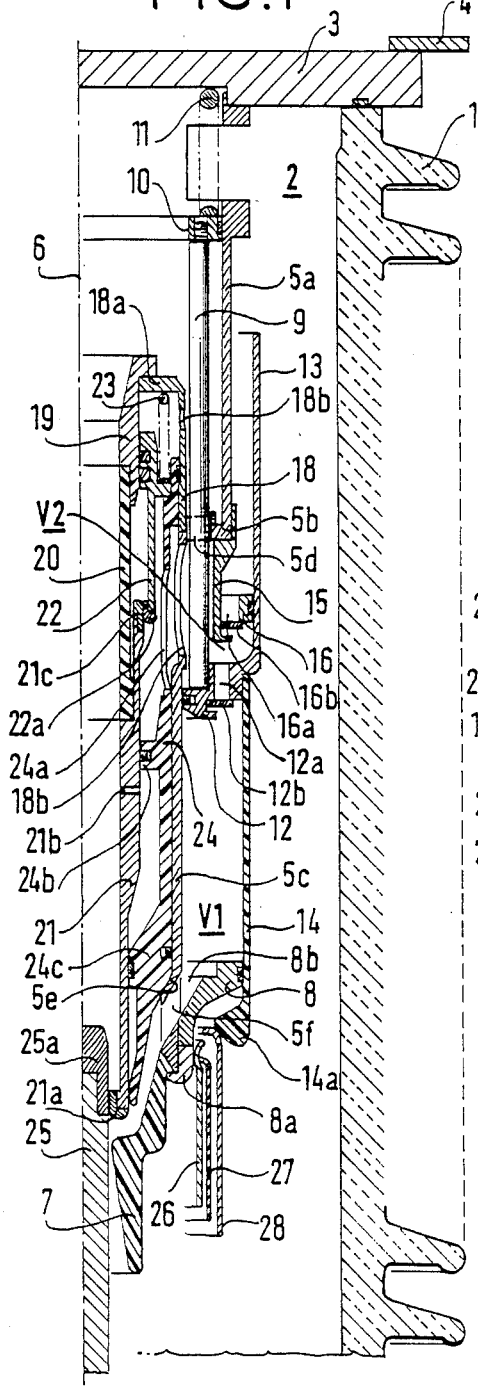
FIG. 1 is an axial half-section view through a first embodiment of a circuit breaker in accordance with the invention and shown in its closed position.

The FIG. 1 circuit breaker comprises an outer envelope 1 made of ceramic material and delimiting a volume 2 which is filled with a dielectric gas such as sulfur hexafluoride, at a pressure of a few bars.

A metal end plate 3 connected to a current terminal 4 closes one end of the envelope.

The end plate is fixed to a metal part comprising a first cylindrical portion 5*a* coaxial with the envelope, an annular portion 5*b* perpendicular to the axis 6 of the envelope, and a second cylindrical portion 5*c* of smaller diameter than the portion 5*a*. The annular portion includes orifices 5*d* which are preferably circular, and which are uniformly distributed towards the edge of the annular portion, e.g. three orifices at 120° from one another.

The cylindrical portion 5*c* has an end 5*e* which is of greater thickness and which is pierced by orifices 5*f* converging towards the axis 6.

An insulating nozzle 7 and a metal part 8 are fixed to this end, with the tubular end 8*a* of the part 8 constituting the fixed permanent contact of the circuit breaker. The part 8 has orifices 8*b* coinciding with the orifices at 5*f* in order to define blast passages. Rods 9 pass through the orifices 5*d*, with first ends of the rods being fixed to a ring 10 which is slidable inside cylinder 5*a* and which is acted upon by a spring 11 bearing against the end plate. The second ends of the rods 9 carry a piston 12 which is extended firstly by a metal cylinder 13 around the cylinder 5*a*, and secondly by an insulating cylinder 14 terminated by a thickened portion 14*a*.

The parts 12, 15, 5*c*, and 8 define a volume V1.

The cylinder 5*a* is extended by a metal part 15 provided with an annular portion 16 constituting a fixed piston which slides along the cylinder 13. V2 designates the volume delimited by the parts 16, 13, 12, 5*c*, and 5*b*.

The pistons 12 and 16 are pierced by orifices respectively referenced 12*a* and 16*a* and associated with moving non-return valves 12*b* and 16*b*.

The annular portion 5*b* is fixed to a metal tube 18 terminated by an annular shoulder 18*a*.

A cylindrical assembly is fixed to this shoulder, said assembly comprising a metal first cylinder 19 extended by an insulating second cylinder 20 which is itself extended by a metal third cylinder 21 terminated by an end 21*a* made of a metal or an alloy which withstands arc wear and which constitutes one of the main arc contacts.

The end of the cylinder 21 opposite to its end 21*a* is extended by a cylindrical portion lying outside the cylinder 20 and terminated by a portion 21*c* constituting one of the auxiliary arc contacts.

The other auxiliary arc contact is a metal part 22 acted upon by a spring 23 bearing against the shoulder 18*a* and provided with an arc-resistant end 22*a*.

Level with the auxiliary arc contacts, the cylinder 5*c* has large openings 18*b*.

An insulating cylinder 24 is fixed to the contact 23. This cylinder has openings 24*a* putting the zone containing the contacts 21*c* and 22*a* into communication with the volume V2 via openings 18*b*.

The cylinder 24 has an annular portion 24*b* provided with a sliding contact which closes the volume V2 by sliding over the cylinder 22.

The end of the cylinder 24 has a thickened portion 24*c* closing the annular space lying between the cylinders 21 and 5*c* and thus constituting a piston.

The section S2 of said space is greater than the section S1 between the part 21 and the end of the part 5*e*.

The moving equipment of the circuit breaker comprises a tube 25 having an arc-resistant end 25*a* which constitutes the main moving arc contact, together with fingers 26 associated with springs 27 and protected by a cover 28, constituting the main fixed contact.

The moving contacts 25 and 26 are connected in conventional manner to a second current terminal, not shown.

They are capable of being moved as a single unit by virtue of an operating rod (not shown).

In the closed position, the cover 28 pushes against the part 14, thereby compressing the spring 11. The main contacts 26 and 8*a* allow the permanent current to pass via the terminal 4, the end plate 3, the cylindrical part 5*a*, 5*b*, 5*c*, 5*e* the contact 8*a*, and the contact 26.

The main arc contacts 25*a*–21*a* and the auxiliary arc contacts 22*a*–21*c* are in contact, and the spring 23 may be relaxed or compressed.

The circuit breaker operates as follows:

a. Interrupting high currents (short circuit currents).

The moving equipment is displaced by the operating rod towards the bottom of the figure.

Figure 2:
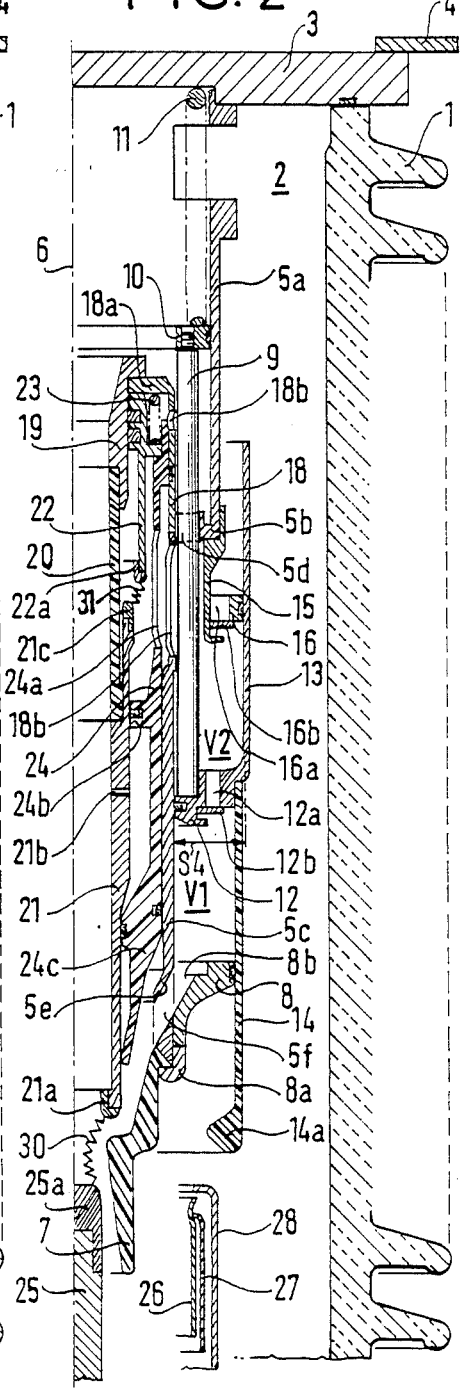
FIG. 2 is an axial half-section through the same circuit breaker, and shown during an opening operation.

The main contacts 26 and 8*a* separate, and then the main arc contacts 25*a* and 21*a* also separate giving rise to a primary arc 30 (FIG. 2).

During displacement of the cover 28, the part 14 follows the movement under the action of the spring 11. As a result, the piston 12 is displaced compressing the volume VI and urging blast gas onto the arc 30 through the channels 8*b*–5*f*.

The increase in pressure in the zone adjacent to the primary arc 30 causes the part 24 to move against the action of the spring 23 (upwardly in the figure). This pressure acts on section S1, and as soon as the part 24 has moved, also on section S2.

The movement separates the auxiliary arc contacts 22*a* and 21*c*, thereby striking a secondary arc. Current then passes via the parts 4, 3, 5*a*, 5*d*, 18, 18*a*, 19, 22, the arc 31, 21*c*, 21 21*a*, the arc 30, 25*a*, and 25.

The arc 31 causes a sharp increase in pressure in the volume V2, thereby increasing the pressure on the piston 12 which, acting on the large area S4 contributes to increasing the blast on the primary arc 30 provided by the gas in volume V1.

It may be observed that during the circuit breaker opening stage, non-return valve 12*b* remains closed since it has a larger area adjacent to volume V1 than to volume V2. The valve 16*b* opens and prevents the pressure in volume V2 reducing when the second arc appears, with the increase in pressure closing it.

When the current passes through zero, the arcs are extinguished and the spring 23 returns the contact 22*a* to make contact with contact 21*c*. Calibrated holes (not shown) ensure that the pressure in volume V2 is dissipated at the end of the circuit breaking operation.

b. Interrupting low currents (interrupting a nominal current, interrupting an inductive current)

The arc 30 provides too little energy for the pressure increase which it generates to be sufficient for displacing the prat 24 against the action of the spring. As a result, there is no secondary arc and no danger of restricking which could give rise to a cascade of voltage surges.

The energy contained in the spring 11 is sufficient to ensure that its effect on the piston 12 blasts the arc 30 properly.

c. Closing

When the circuit breaker is closed, by displacing the moving equipment upwards (as shown in the figure), the cover 28 pushes the part 14 against the action of the spring 11. The valve 12*b* opens and the valve 16*b* closes, thereby filling the volume V1 from the volume V2.

Decompression holes 21*b* in the part 21 and 18*b* in the part 18 serve to equalize pressures and reduce the energy required for closing the circuit breaker.

In the above-described embodiment, the threshold value of the current to be interrupted above which a secondary arc is established, is adjusted by the force of the spring 23.

The circuit breaker can therefore be used for high- or medium-tension and desired operating thresholds can easily be adjusted.

In the embodiment shown in FIGS. 1 and 2, the blast piston and the auxiliary arc contacts belong to the fixed portions of the circuit breaker.

Figure 3:
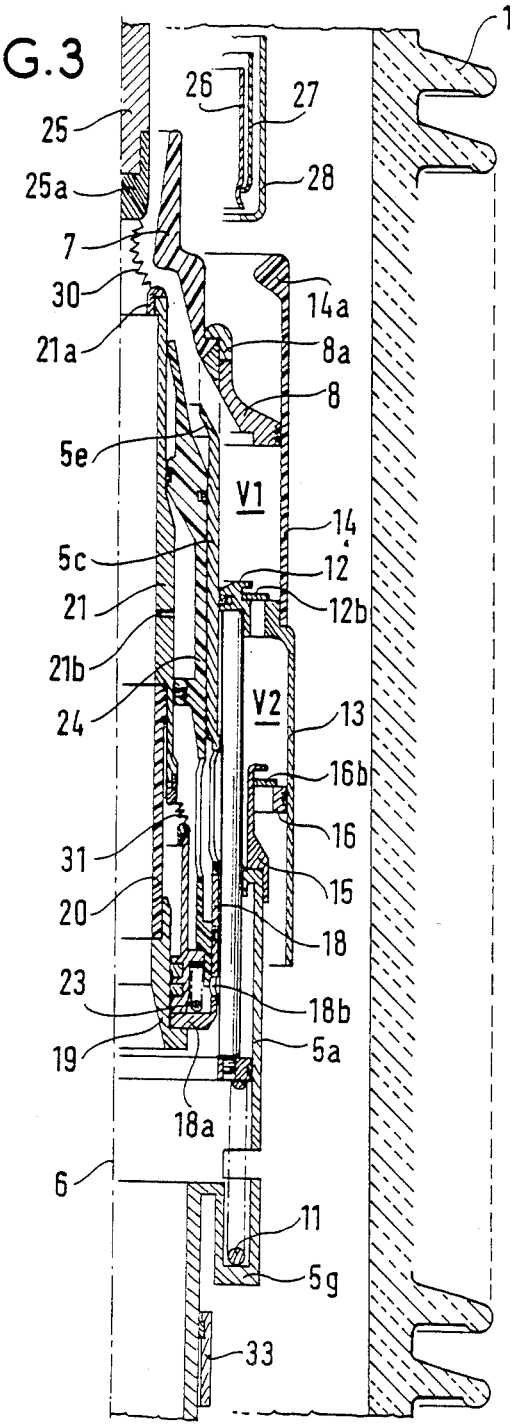
FIG. 3 is an axial half-section through a second embodiment of a circuit breaker shown during an opening operation.

FIG. 3 shows a circuit breaker in which the blast piston and the auxiliary arc contacts belong to the moving equipment.

Items performing the same functions in FIGS. 1 and 3 are given the same reference numbers.

At the top of the figure, contacts 25–25*a* and 26–27–28 are fixed. The remaining parts in the figure belong to the moving equipment.

The spring 11 now bears against a groove 5*g* in the part 5*a*–5*b*–5*c* which is guided in a fixed tube 33.

The blast piston 12 is not coupled to the moving contact.

Operation is identical to that described with reference to FIGS. 1 and 2, with the energy for blasting the arc produced by low currents still being provided by the spring 11.

Since the mass of the moving equipment is greater than the mass of the moving equipment in the circuit breaker shown in FIG. 1, it will often be preferable to use the FIG. 1 solution instead of that shown in FIG. 3.

In circuit breakers of the type described above, prestriking may occur at high nominal voltages during circuit breaker closing operations.

Prestriking causes the secondary arcing contacts to open, thereby causing an arc to increase the pressure in the volume V2. Means must therefore be provided for evacuating gas from said volume into the volume 2 since, otherwise, the circuit breaker cannot close.

Figure 4:
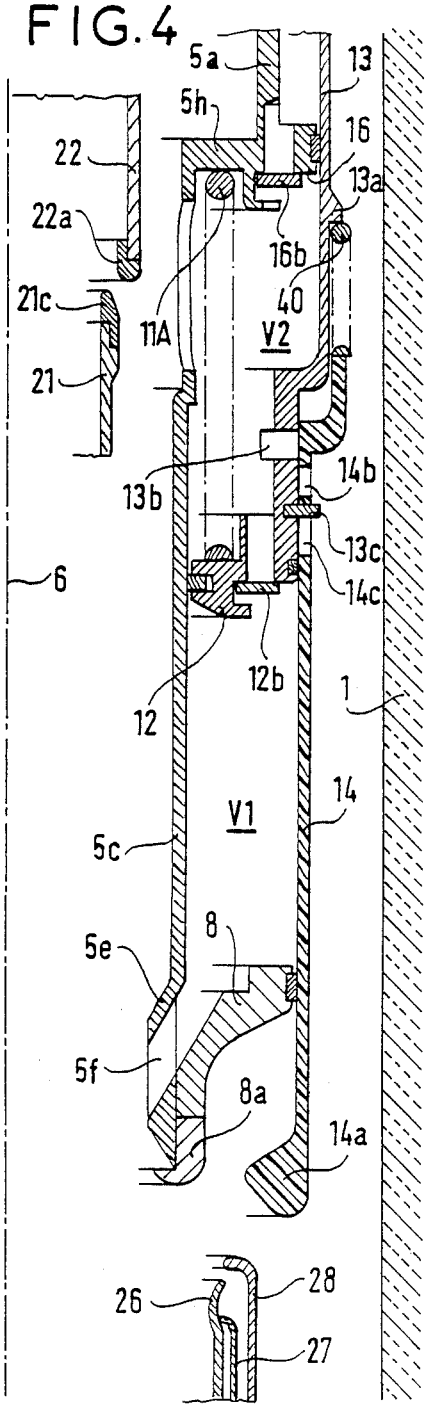
FIG. 4 is a fragmentary axial section through an embodiment of the circuit breaker similar to that shown in FIG. 1, and shown in its open position.

FIG. 4 is a fragmentary view of a circuit breaker in accordance with the invention in which items common to FIG. 1 and 4 have the same reference numbers.

It will be observed that in this case the spring 11*a* for operating the piston 12 bears against an annular shoulder 5h of the part 5*a*.

In order to allow gas to escape from the volume V2 during closure, the circuit breaker has the following characteristics: the cylinder 14 is capable of moving relative to the cylinder 13 by virtue of a spring 40 bearing against a ledge 13*a* on the part 13. The cylinder 13 has radial orifices 14*b*. The same is true of the part 14 which has radial orifices 14*b* situated in such a manner that the orifices 13*b* can be brought to coincide with the orifices 14*b* by relative sliding between the parts 13 and 14.

In addition, the orifices 13*b* and 14*b* are situated relative to each other in such a manner that when the circuit breaker is open or is opening (FIG. 4), these orifices are not in coincidence, thereby leaving the volume V2 closed.

Figure 5:
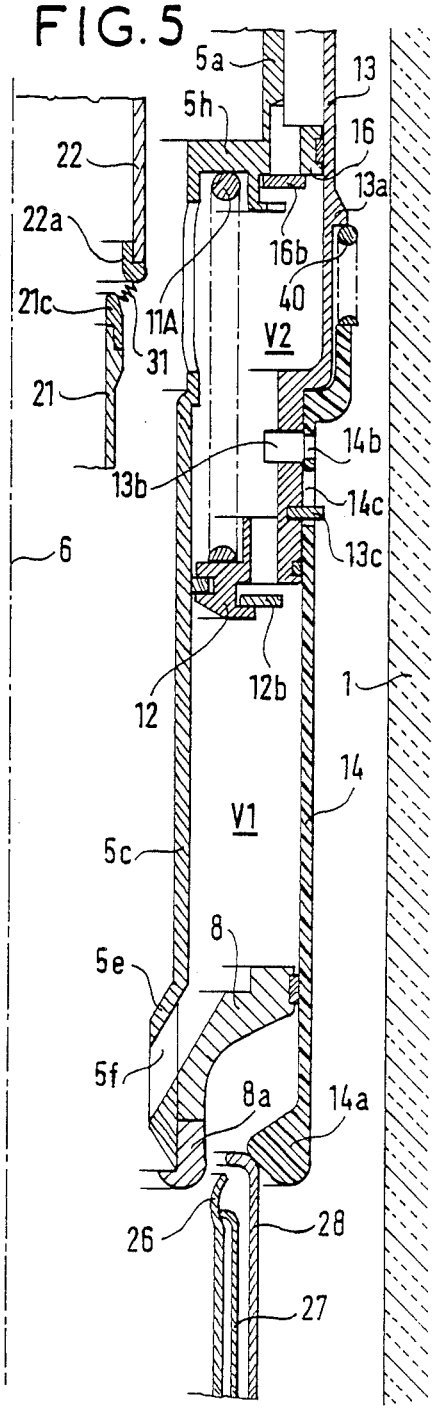
FIG. 5 is the same fragmentary view but showing the circuit breaker during a closing operation.

While the circuit breaker is closing (FIG. 5), the cover 28 pushes the part 14 against the action of the spring 40.

The orifices 13*b* and 14*b* then come into coincidence, thus making it possible to evacuate excess pressure to the secondary arc 31, if any.

Naturally, the force of the spring 40 is much less than the force of the spring 11*a*.

The stroke of the part 14 may be limited by a peg 13*c* fixed to the cylinder 13 and co-operating with a slot 14*c* in the part 14.

Figure 6:
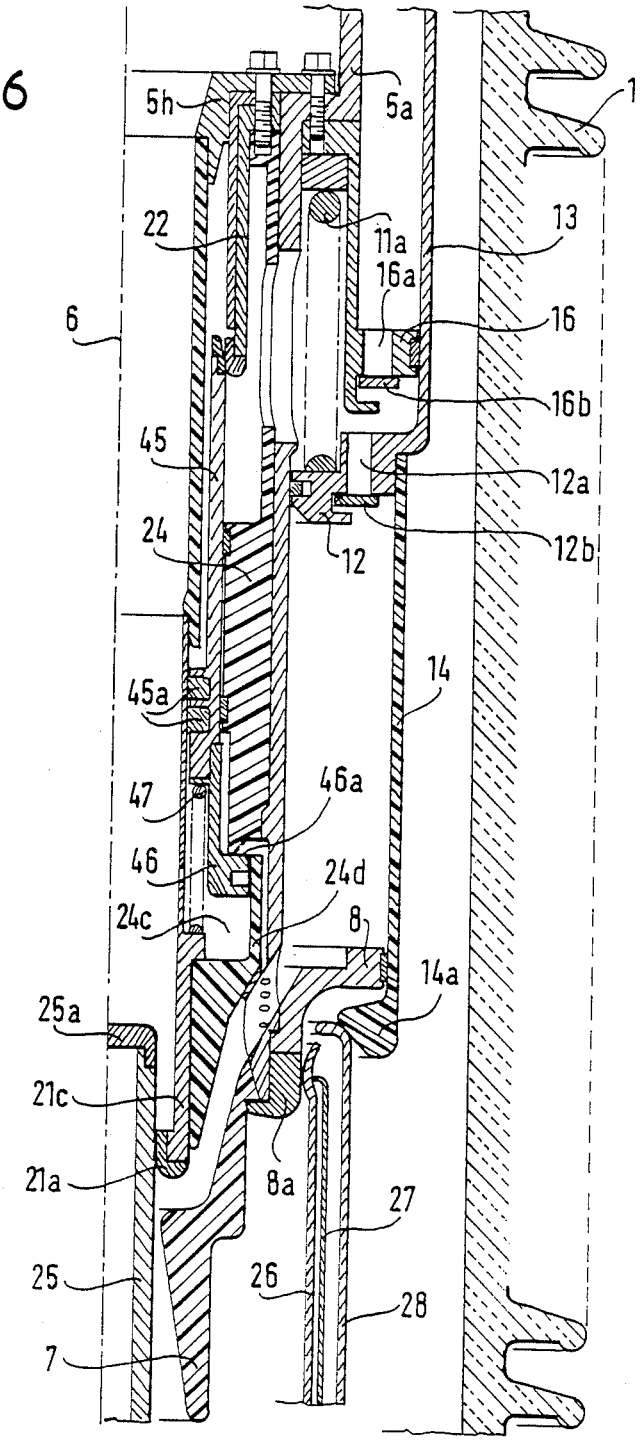
FIG. 6 is a fragmentary axial section through a third embodiment of a circuit breaker in accordance with the invention.

FIG. 6 is a fragmentary axial half-section through a variant embodiment of a circuit breaker.

Items which are common to FIGS. 1, 4, and 6 have the same reference numbers.

In the variant, the auxiliary contact 22 and the part 24 are non-moving and are fixed to the part 5*a*.

The second auxiliary contact, now referenced 45, slides in a housing 24*c* in the part 24 under the action of a piston 46 having one face 46*a* put into communication with the main arc zone by means of grooves. A spring 47 returns the contacts 45. The contact 45 is provided with sliding contacts 45*a* allowing current to pass between the contact 45 and the main arc contact.

When the main arc is struck, the piston moves, thereby compressing the spring 47 and separating the auxiliary arc contacts.

The invention is not limited to the embodiments described and shown.

It is applicable, for example, to the circuit breaker described in French patent application No. 86 04 393 filed Mar. 26, 1986, where the person skilled in the art will readily understand how to transpose the solutions described above.

We claim:

1. A high- or medium-tension compressed gas circuit breaker taking circuit-breaking energy from the arc, the circuit breaker being of the type comprising:

a fixed assembly including main contacts and arc contacts;

a moving assembly including main contacts and arc contacts;

a blast volume including a piston which moves on contact separation and urges compressed gas through a blast nozzle which opens over the zone where a main arc forms when the arc contacts separate, and a set of auxiliary contacts in series with the arc contacts for creating an auxiliary arc in the volume situated behind the piston, the circuit breaker further including means for allowing the auxiliary contacts to separate only when the pressure in the blast zone reaches a predetermined threshold.

2. A circuit breaker according to claim 1, wherein said means comprise a piston fixed to one of the auxiliary contacts and subjected to the pressure in the main arc zone, and a return spring for returning said auxiliary contact.

3. A circuit breaker according to claim 1, wherein the auxiliary contacts belong to the fixed assembly.

4. A circuit breaker according to claim 1, wherein the auxiliary contacts belong to the moving assembly.

5. A circuit breaker according to claim 1, wherein the volume situated behind the piston includes at least one opening associated with closure means for closing said opening when the circuit breaker is opening.

6. A circuit breaker according to claim 5, wherein said closure means comprises a cylinder provided with an opening and connected to the moving assembly by a spring.

* * * * *